US008136569B2

(12) United States Patent
Bohlen et al.

(10) Patent No.: US 8,136,569 B2
(45) Date of Patent: Mar. 20, 2012

(54) OPERATING AND MOUNTING SYSTEM FOR A WINDOW COVERING

(75) Inventors: Jorg Bohlen, Langen (DE); Lars Koop, Bremerhaven (DE)

(73) Assignee: Hunter Douglas Industries BV, El Rotterdam (NL)

( * ) Notice: Subject to any disclaimer, the term of this patent is extended or adjusted under 35 U.S.C. 154(b) by 274 days.

(21) Appl. No.: 12/439,231

(22) PCT Filed: Aug. 24, 2007

(86) PCT No.: PCT/EP2007/007457

§ 371 (c)(1),
(2), (4) Date: Feb. 27, 2009

(87) PCT Pub. No.: WO2008/025494

PCT Pub. Date: Mar. 6, 2008

(65) Prior Publication Data

US 2009/0258752 A1 Oct. 15, 2009

(30) Foreign Application Priority Data

Sep. 1, 2006 (EP) ..... 06018373

(51) Int. Cl.
*A47G 5/02* (2006.01)

(52) U.S. Cl. ..... 160/323.1; 160/324; 160/321; 160/307; 160/903; 192/223.4; 192/223; 74/405; 74/411.5

(58) Field of Classification Search ..... 160/321, 160/323.1, 324, 291, 307, 903; 192/223.4, 192/223; 74/405, 411.5
See application file for complete search history.

(56) References Cited

U.S. PATENT DOCUMENTS

| | | | | | |
|---|---|---|---|---|---|
| 1,806,650 | A | * | 5/1931 | Schmelz | 160/298 |
| 3,135,369 | A | * | 6/1964 | Nisenson et al. | 192/223.4 |
| 4,125,142 | A | * | 11/1978 | Fohl | 160/291 |
| 4,372,432 | A | * | 2/1983 | Waine et al. | 192/223.4 |
| 4,673,073 | A | * | 6/1987 | Weatherby | 192/35 |
| 4,751,953 | A | * | 6/1988 | Appel et al. | 160/313 |
| 5,361,822 | A | * | 11/1994 | Nijs | 160/321 |
| 5,375,643 | A | * | 12/1994 | Rude | 160/321 |

(Continued)

FOREIGN PATENT DOCUMENTS

DE 43 44 627 C1 5/1995

(Continued)

*Primary Examiner* — Blair M Johnson
*Assistant Examiner* — Marcus Menezes
(74) *Attorney, Agent, or Firm* — Dorsey & Whitney LLP

(57) ABSTRACT

An operating unit (5) for operating a window covering. The operating unit (5) includes a housing (11), a rotatable drive pulley (13) having an axis of rotation and first and second mounting positions in the housing, with respect to the axis of rotation, an engagement device (15), rotatable about the axis of rotation, and a brake mechanism (45, 47, 49) for, in use, arresting the engagement device when the drive pulley (13) is not rotated and preventing the engagement device and drive pulley from being back driven by the window covering. The engagement device (15) has a plurality of circumferentially spaced pins (19) parallel to the axis of rotation. The drive pulley (13) has a corresponding plurality of openings (17) facing the pins (19). In the first mounting position, the pins on the engagement device (15) engage with the corresponding openings (17) in the drive pulley and the engagement device rotates with the drive pulley. In the second mounting position, the pins (19) do not so engage and the engagement device (15) thereby can rotate relative to the drive pulley (13).

24 Claims, 9 Drawing Sheets

U.S. PATENT DOCUMENTS

| | | | | |
|---|---|---|---|---|
| 5,507,374 | A * | 4/1996 | Rude | 192/223.4 |
| 5,647,421 | A * | 7/1997 | Hoffmann et al. | 160/120 |
| 5,975,186 | A * | 11/1999 | Day | 160/321 |
| 6,158,563 | A * | 12/2000 | Welfonder et al. | 192/223.3 |
| 6,173,825 | B1 * | 1/2001 | Liu | 192/223.4 |
| 6,685,592 | B2 * | 2/2004 | Fraczek et al. | 475/14 |
| 6,935,401 | B2 * | 8/2005 | Fraczek et al. | 160/321 |
| 7,100,668 | B2 * | 9/2006 | Allsop | 160/321 |
| 7,677,293 | B2 * | 3/2010 | Allsopp | 160/323.1 |
| 2003/0085003 | A1 * | 5/2003 | Cheng | 160/321 |
| 2005/0039866 | A1 * | 2/2005 | Allsopp | 160/321 |
| 2005/0247413 | A1 * | 11/2005 | Nien et al. | 160/321 |
| 2007/0107857 | A1 * | 5/2007 | Wang | 160/321 |
| 2008/0153606 | A1 * | 6/2008 | Koop et al. | 464/83 |

FOREIGN PATENT DOCUMENTS

| | | |
|---|---|---|
| EP | 1 643 077 A2 | 4/2006 |

* cited by examiner 3A
131
137
139
135
143
141
133
145
147
77
71
79
11
5

OPERATING AND MOUNTING SYSTEM FOR A WINDOW COVERING

The present invention relates to operating unit for operating a window covering.

Such units are generally known from and, amongst others, described in U.S. Pat. No. 6,685,592. Sometimes drive units are required that drive with an increased torque, albeit at the cost of a reduced speed. While this is generally acceptable for heavier window coverings, the reduced speed can be a nuisance for lighter and/or smaller window coverings that do not require much force to operate. It has thus become customary to offer at least a choice of different drive units for differently sized window coverings. This has resulted in larger than desirable stock and difficulties in the supply chain.

Accordingly it is an object of the present invention to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice.

To this end the present invention provides an operating unit for operating a window covering, the operating unit including a housing; a rotatable drive pulley having an axis of rotation and first and second mounting positions in the housing, with respect to the axis of rotation; an engagement device, rotatable about the axis of rotation; and a brake mechanism for, in use, arresting the engagement device when the drive pulley is not rotated and preventing the engagement device and drive pulley from being back driven by the window covering, wherein the engagement device has a plurality of circumferentially spaced pins parallel to the axis of rotation, wherein the drive pulley has a corresponding plurality of openings facing the pins and wherein in the first mounting position the pins on the engagement device engage with the corresponding openings in the drive pulley and the engagement device rotates with the drive pulley, while in the second mounting position the pins do not so engage and the engagement device thereby can rotate relative to the drive pulley. In this way it has become possible to create at least two different drive units from a majority of identical components, which should solve most of the stock keeping and supply problems. It has even become possible to modify an existing drive unit of one type into one of the other type and vice versa.

According to another aspect of the invention there is provided a combination of the operating unit and a mounting bracket.

Other aspects, features and details of the present invention can be more completely understood by reference to the following detailed description of preferred embodiments, taken in conjunction with the drawings and from the appended claims. In the appended drawings:

Figure 1:
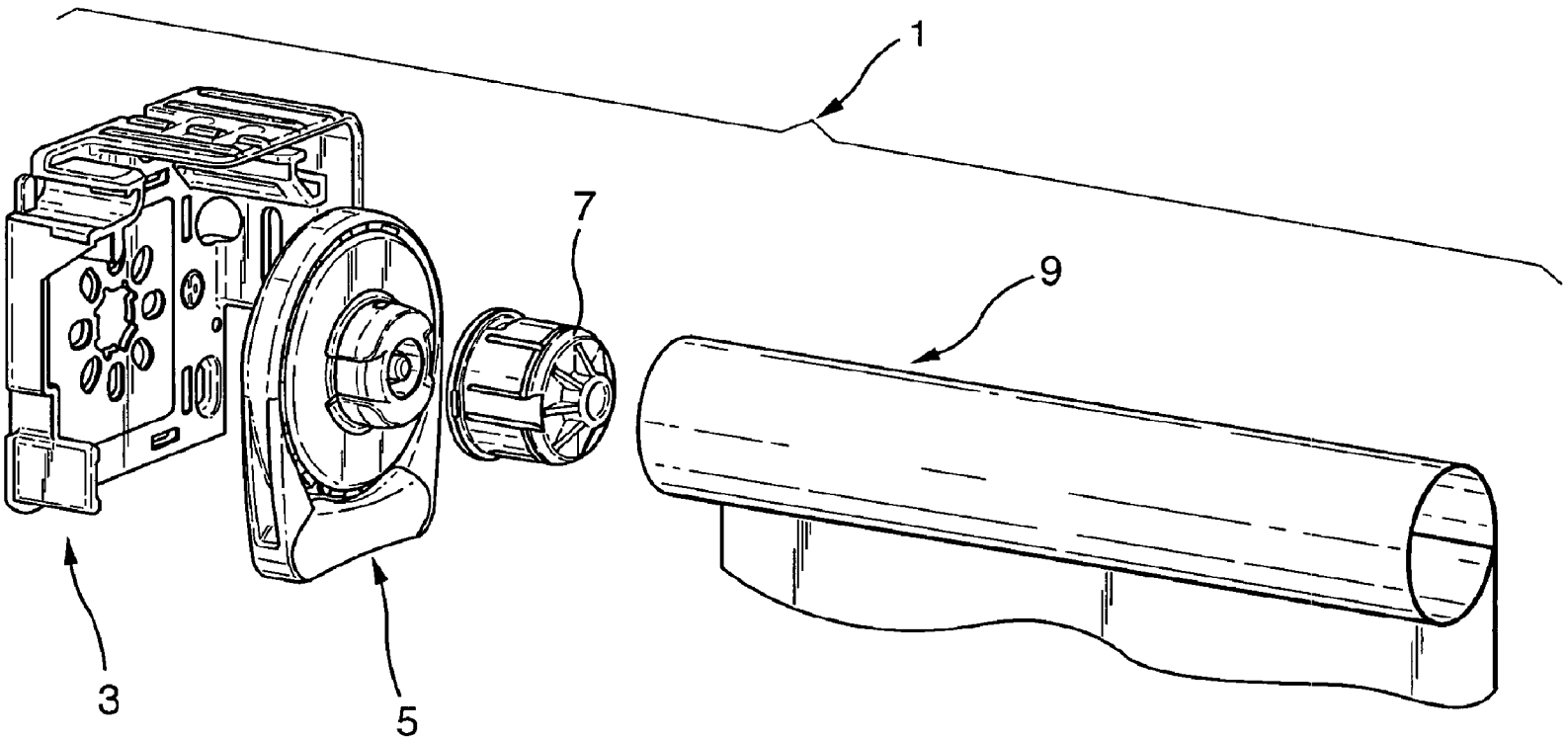
FIG. 1 is a partly exploded arrangement of the operating and mounting system of the present invention.

FIG. 1 shows an operating and mounting system 1 according to the invention. Included in the system is a mounting bracket 3, an operating unit 5 and adapter plug 7 and a blind roller 9. The mounting bracket 3, as illustrated in FIG. 1, is of a type suitable a so called cassette system, wherein the blind roller 9 is enclosed in a housing or head box (not shown, but conventional). The bracket 3 as shown in FIG. 1 is adapted to connect with such a housing or headbox and acts as an end wall therefore.

Alternative Forms of Mounting Brackets Will be Described Herein Below.

Figure 2:
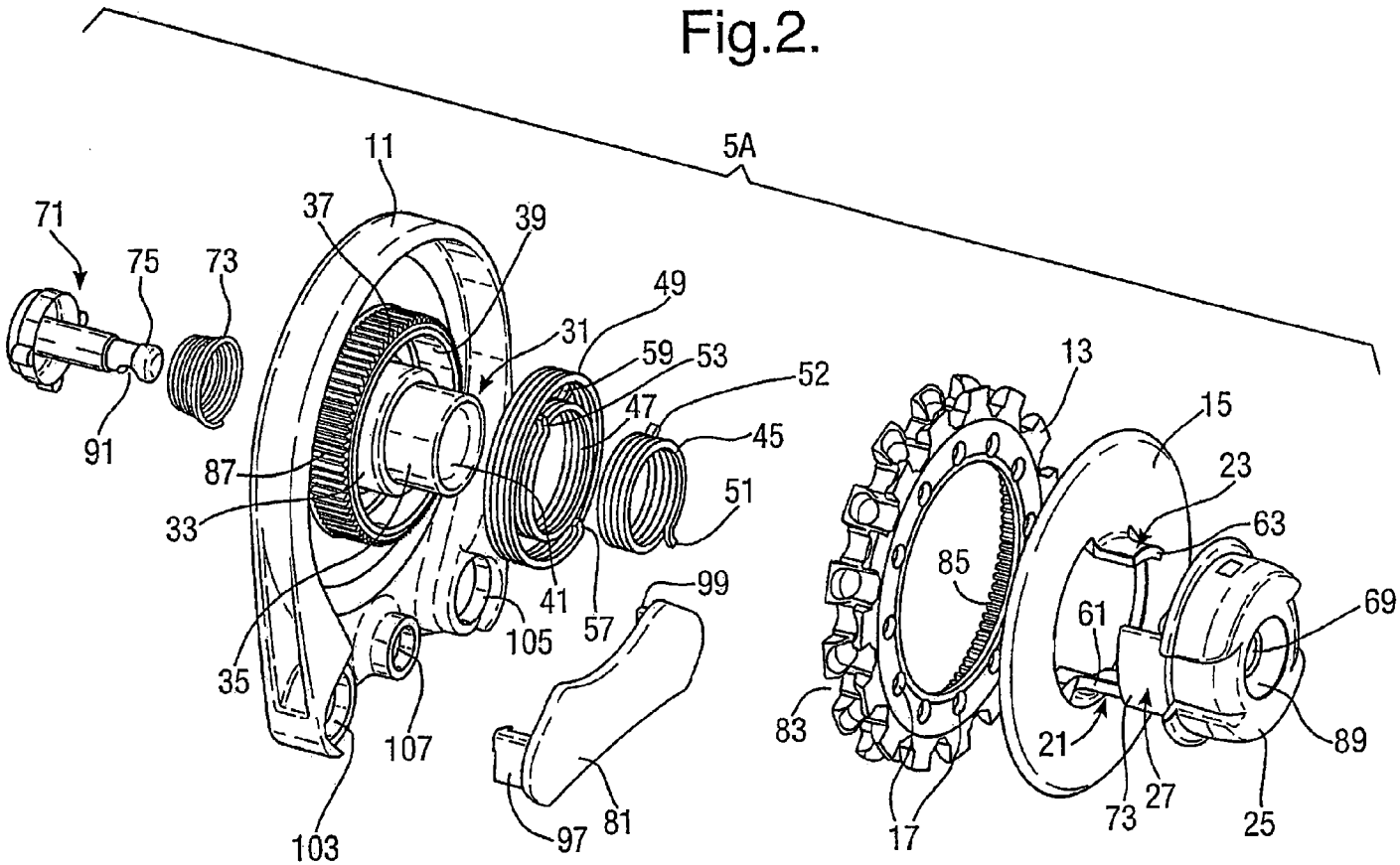
FIG. 2 is an exploded view of a first embodiment of operating unit for use in the arrangement of FIG. 1.
Figure 3:
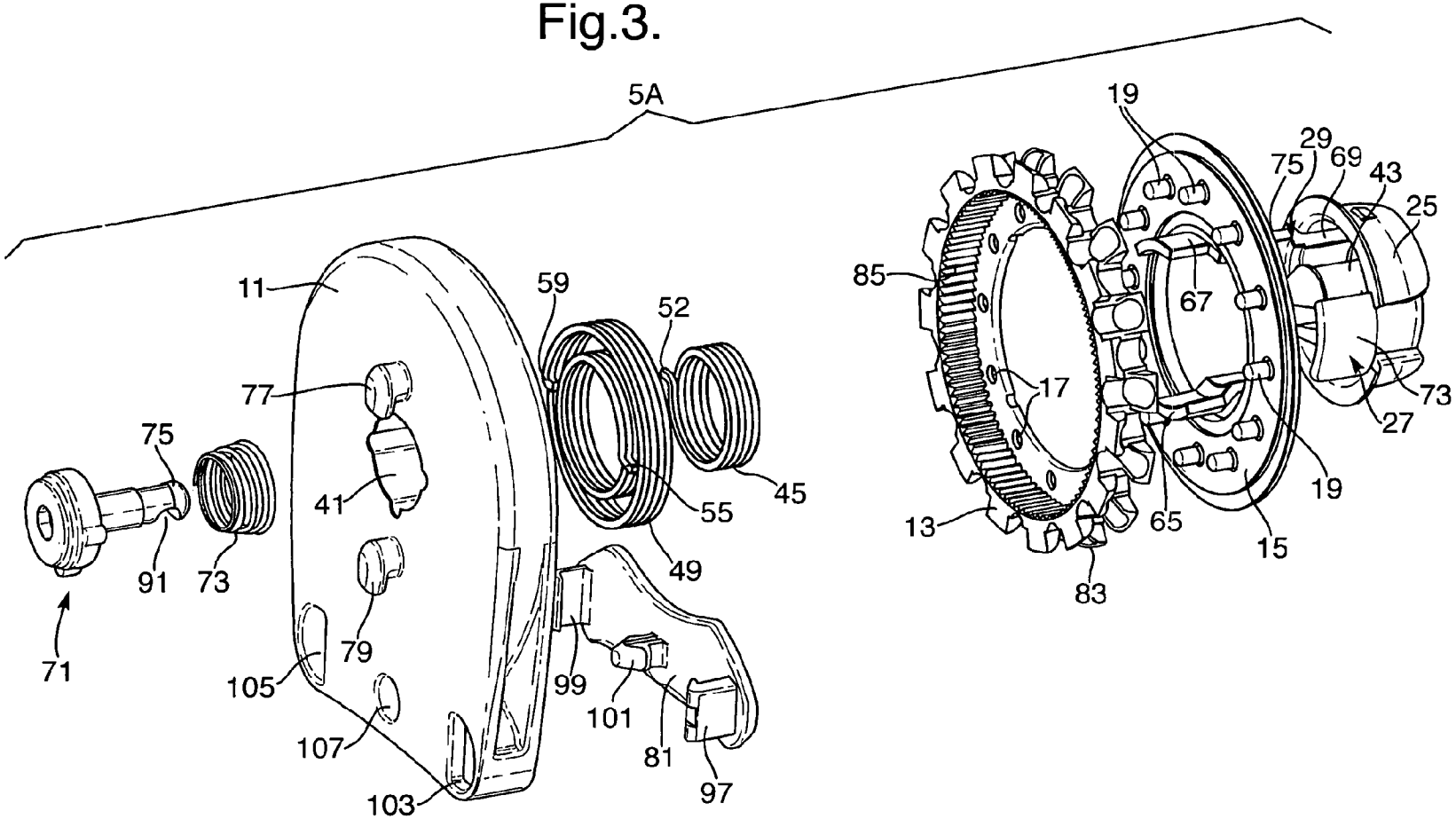
FIG. 3 is an exploded view of the first embodiment operating unit of FIG. 2 as viewed from an opposite direction.

FIGS. 2 and 3 show a first embodiment of operating unit 5A in exploded view. This includes a housing 11, a chain wheel 13 an engagement device 15. The chain wheel 13 is rotatably journalled on the housing 11 and may be rotated by a conventional ball chain (not shown). The chain wheel 13 has a circular array of equally spaced round holes 17. In the illustrated embodiment, there are twelve such holes 17, but this is optional and the number may as well be six or three subject to requirement. The engagement device 15 has a corresponding or smaller number of round pins 19 which engage in the holes 17 of the chain wheel 13.

Rotation of the chain wheel 13 will thereby rotate the engagement device 15. The engagement device 15 has axially extending bosses 21, 23 for rotatably engaging a connector 25. The connector 25 has complementary axially extending bosses 27, 29. The housing 11 has a central drum portion 31 having a large diameter 33 and a small diameter section 35. Surrounding the central drum portion 31 is a concentric drum portion 37 with an internal drum surface 39. The central drum portion 31 further defines a central bore 41, which rotatably receives an internal journal 43 on the connector (FIG. 3). A total of three different wrap springs 45, 47 and 49 is provided for arresting the connector 25 against rotation when it is not being driven by the engagement device 15. Optionally any number and combination of the three wrap springs 45, 47 and/or 49 can be used in dependency of the arresting force required. The wrap spring 45 sits snugly on the small diameter section 35. Wrap spring 47 will snugly fit on the large diameter section 33 and the wrap spring 49 fits snugly inside the concentric drum portion 37 and contacts the internal drum surface 39. Each of the wrap springs 45 and 47 has radially outwardly directed tangs 51, 52, 53 and 55 extending from their outermost spring windings. The wrap spring 49 has tangs, 57, 59 that are directed inwardly. As can be seen from comparing FIGS. 2 and 3, the axially extending bosses 21 and 23 on the engagement device 15 extend from both sides thereof. The boss portions 61, 63 that face the connector 25 are radially spaced are a diameter small enough to fit within the connector 25 and large enough to clear a wrap spring 45 mounted around the small diameter section 35 of the drum portion 31. The boss portions 65, 67 that face the chain wheel 13 are radially spaced are a diameter large enough to clear a wrap spring 47 mounted on 45 mounted around the large diameter section 33, but still small enough to fit inside a wrap spring 49 mounted within the internal drum surface 39. The corresponding bosses 27, 29 of the connector 25 have corresponding small diameter portions 69 on the interior thereof and large diameter portions 73, 75 that correspond in diameter with the boss portions 61, 63 and 65, 67 respectively of the engagement device 15. In use the boss portions 61 and 63 are positioned to engage the tangs 51 and 52 of the wrap spring 45 in a direction releasing it from the drum section 35, while the boss portions 69 within the connector 25 engage against the tangs 51 and 52 in a direction increasing the grip on the drum section 35. The boss portions 65 and 67, as well as 73 and 75 of the engagement device 15 and connector 25, respectively, are similarly positioned with respect to the tangs 53 and 55, and 57 and 59, of wrap springs 47 and 49 respectively. In this regard it should be understood that wrap spring 49, because it acts against an outer surface, as an inversed action as opposed to the other wrap springs 45 and 47. While the latter release their braking action by expansion of their winding, wrap spring 49 releases its braking action by contraction of its spring winding (see also FIG. 7). Such wrap springs are however conventional and their use is well known in the art.

The connector 25 is provided with a central bore 69, which in use, is concentric with the bore 41 in the housing 11. Slidably engaged in the central bore 69 is latch plug 71 for the purpose of securing the housing 11 to a mounting bracket, as will be further described herein below. The latch plug 71 is also retained in the central bore 69 of the connector 25 by a stem with an enlarged head 75. As seen in FIG. 3, the housing 11 is also provided with hook members 77, 79 for mounting to a bracket to be described herein below. Further there is provided a guarding bridge 81, that snap-fits onto the housing 11 as a separate element, to guide and retain the ball chain (not shown, but conventional), after it has been positioned in the housing 11. For engagement by a ball chain (not shown, but conventional) the chain wheel 13 is provided with a pattern of circumferential cavities 83. Further it is seen that the chain wheel 13 gas gear teeth 85 on an internal surface and the concentric drum portion has gear teeth 87 on an exterior surface. These gear teeth are only functional with the second embodiment as will be explained in relation to FIG. 8 and onward.

Figure 4:
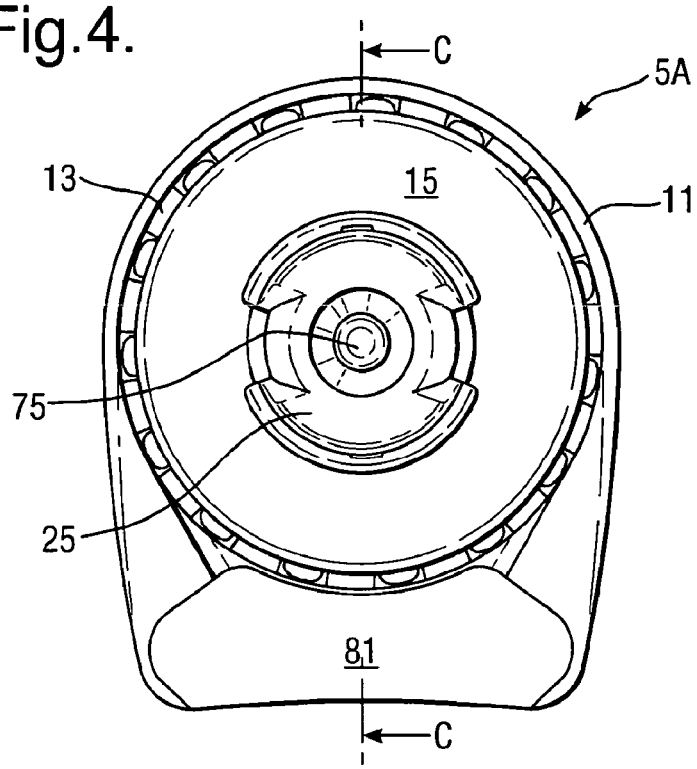
FIG. 4 is an elevation of the assembled first embodiment of operating unit of FIGS. 2 and 3 viewed from its driving end.
Figure 5:
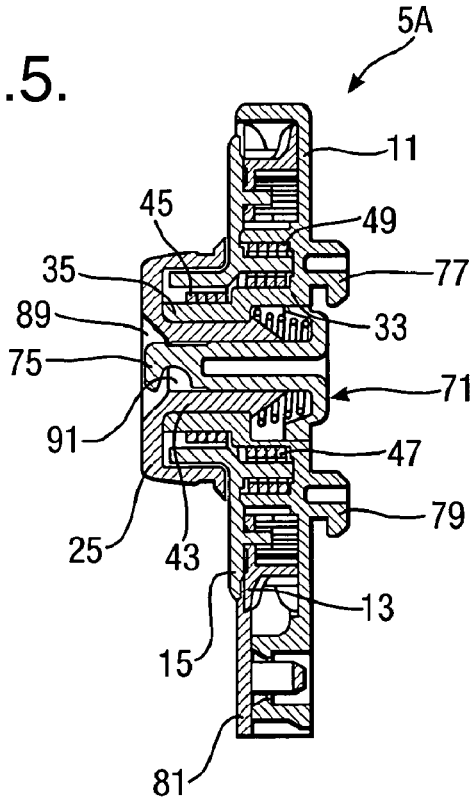
FIG. 5 is a cross section of the first embodiment operating unit according to the line C-C in FIG. 4.

FIG. 4 is an end elevation of the device of FIGS. 2 and 3 in assembled form. Those parts visible have been indicated by the numerals discussed in relation to FIGS. 2 and 3. FIG. 5 is a longitudinal cross section of the assembled device according to the line C-C indicated in FIG. 4. The relative position of the various parts already described in relation to FIGS. 2 and 3 is readily recognisable in FIG. 5.

Also visible in FIG. 5 (and FIG. 2) is that the central bore 69 of the connector 25 opens into a recess 89 and that the stem of the latch plug 71 has a notch 91. The notch 91, when assembled, extends into the recess 89 and can be reached by a tool for a purpose to be described herein below.

Figure 6:
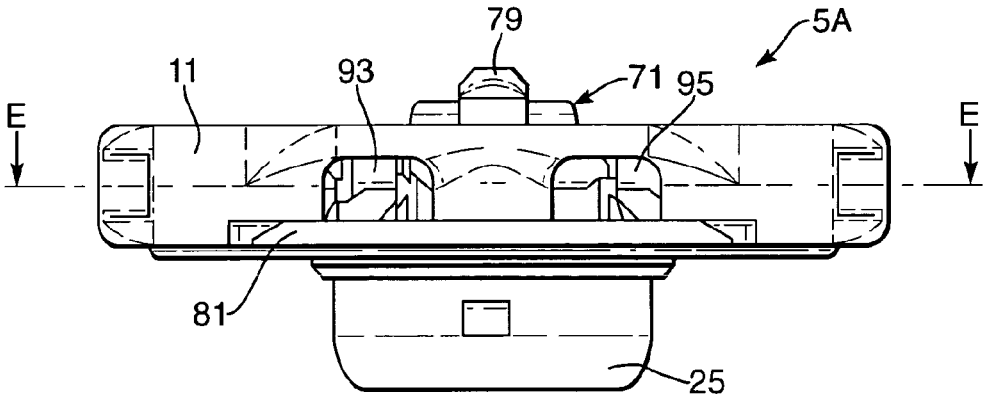
FIG. 6 is a bottom plan view of the first embodiment of operating unit.

FIG. 6 is a bottom view of the operating unit 5A and shows openings 93 and 95 from which a ball chain (not shown but conventional) may extend to drive the chain wheel 13 inside.

Figure 7:
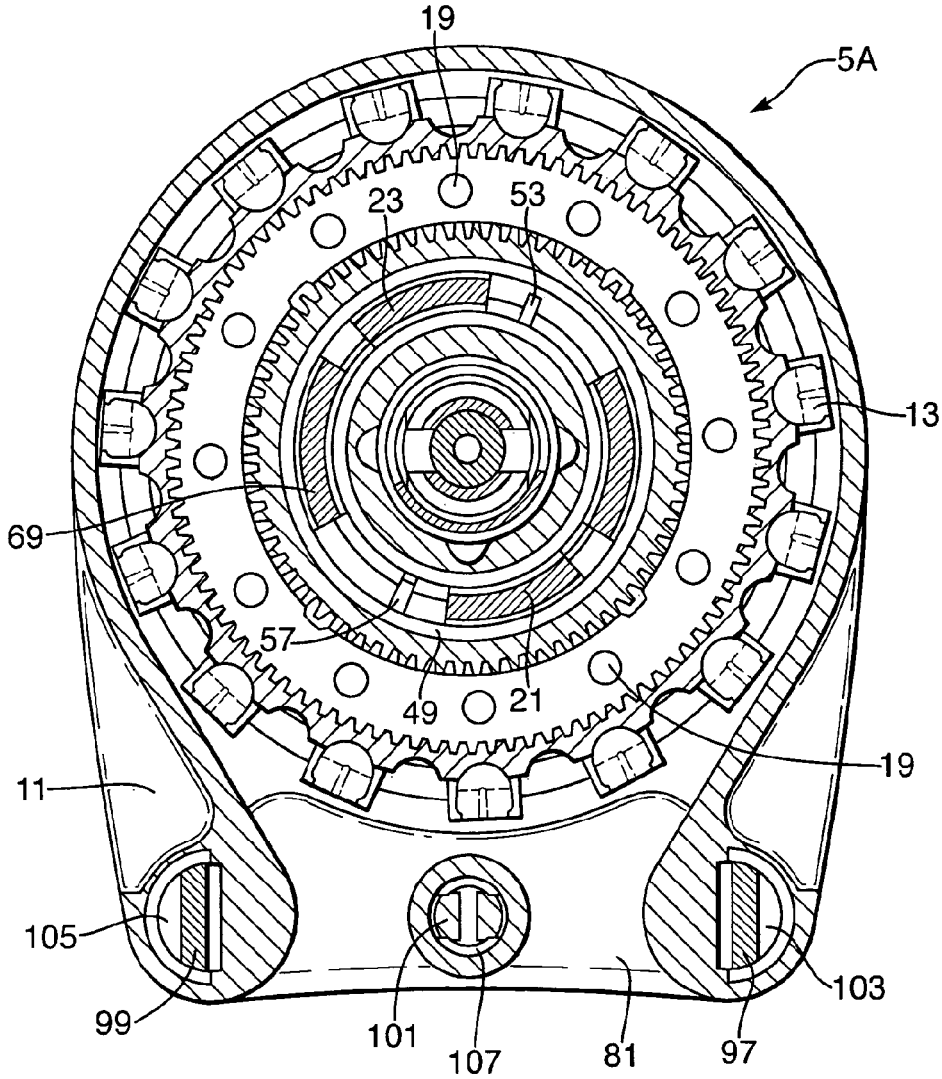
FIG. 7 is a cross section if the first embodiment of operating unit according to the line E-E in FIG. 6.

FIG. 7 is a cross section according to the line E-E indicated in FIG. 6. It can be seen in FIG. 7, that when the boss 69 inside of the connector 25 is being moved in an anti-clockwise direction, by the weight of the shade, it will soon engage the tang 57 of wrap spring 49. As pressure on the tang 57 in this direction will expand the wrap spring 49 against the internal drum surface 39 this will inhibit any further movement of the connector 25 by means of the boss 69. Conversely if the boss 21 of engagement device 15 is moved by the chain wheel in a clockwise direction, then the tang 57 is engaged from an opposite side and will contract the wrap spring 49 to diminish its contact with the internal drum surface 39. As a result the opposite side of tang 57 will engage the boss 69 and through it rotate the connector 25 by which the adapter plug 7 and the shade roller 9 may be rotated. A similar interaction, which is typical for wrap spring brakes, takes place between the tang 53 of wrap spring 47 and the boss 23 of engagement device 15.

Figure 8:
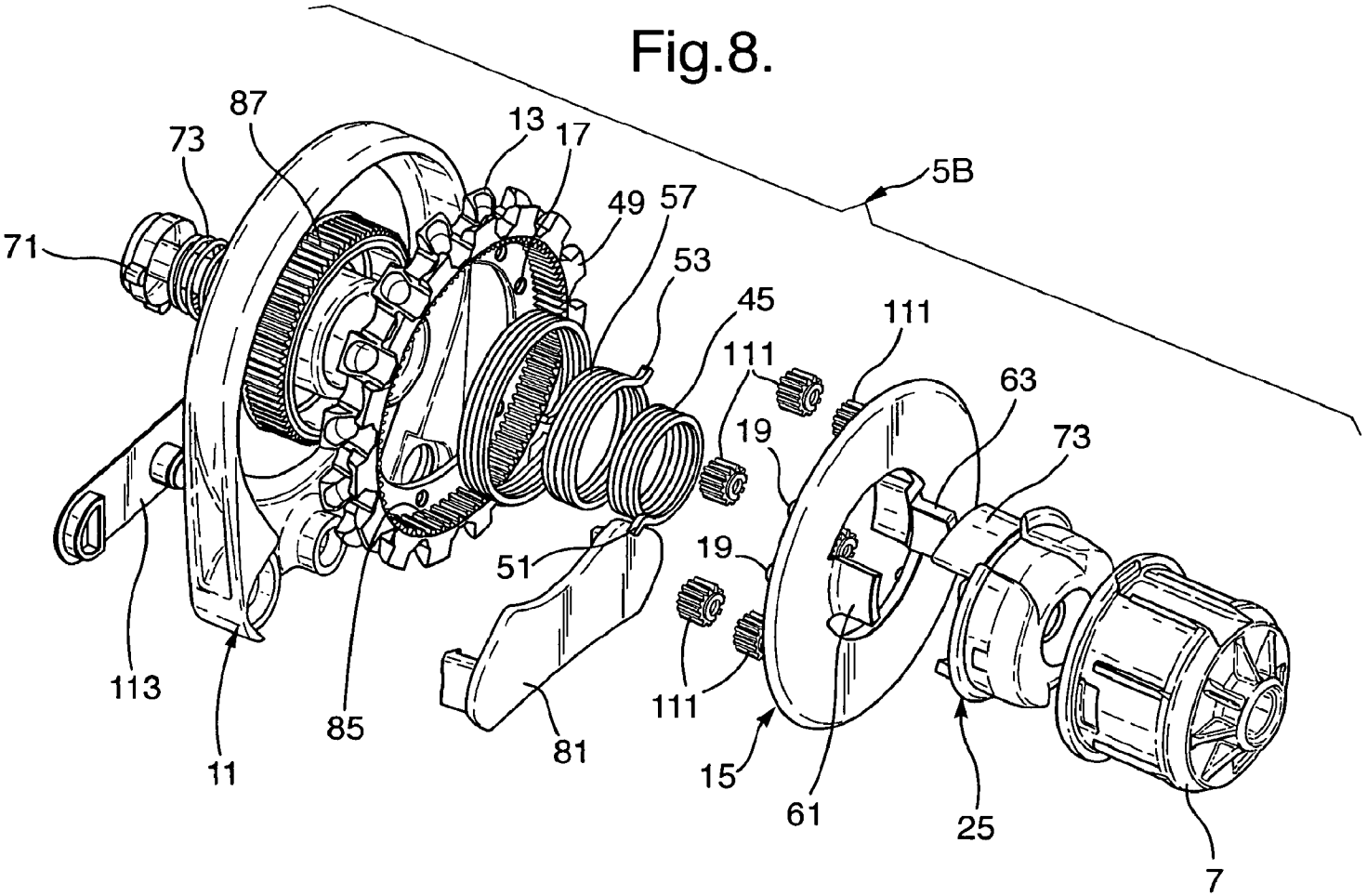
FIG. 8 is an exploded view of a second embodiment of operating unit for use in the arrangement of FIG. 1.

Also visible in FIG. 7 is how springs 97, 99 and 101 on guarding bridge 81 engage into the corresponding openings 103,105 and 107 in the housing 11. Now reverting to FIG. 8, which is an exploded view somewhat similar to FIG. 2, there is shown a second embodiment of the invention. In this embodiment the drive from the chain wheel 13 is not transmitted directly to the engagement device 15, but through a reduction gearing. In particular for heavier blinds it mat be convenient to have the output to the roller rotate at half the speed of the chain wheel, but with twice the torque. Other ratios are of course within the possibility of the system. It is readily seen in FIG. 8 that the chain wheel 13 takes an inverted position to that shown in FIG. 2. In this arrangement or mounting position of the chain wheel 13, the pins 19 on the engagement device 15 will not extend into the apertures 17 because they are too short. The pins 19 are however long enough to rotatably carry a convenient number of gear pinions 111. A total of six pinion 111 are shown in FIG. 8, but conveniently a total of twelve pins 19 are provided, so that three, six or twelve pinions 111 can be used selectively to transmit torque between the chain wheel 13 and the engagement device 15. In use the pinion gears 111 each mesh with the external gear teeth 87 on the stationary housing and with the internal gear teeth 85 of the chain wheel 13. The effect is that the engagement device 15, which acts as a satellite carrier for the pinions 111, is rotated at a fraction of the rate at which the chain wheel 13 is rotated, but also produces an increased torque.

In addition to the drive unit described in relation to FIGS. 2 and 3, the second embodiment drive unit 5B is provided with a cover plate 113 which can be used to improve the appearance of the assembled unit by covering the apertures 103, 105, 107 which would otherwise be visible. The cover plate 113 can also be used for branding the device with the name or trademark of the supplier. The remainder of the components used to constitute the second embodiment drive unit 5B are all identical to those of the first embodiment and a detailed description is therefore deemed superfluous.

Figure 10:
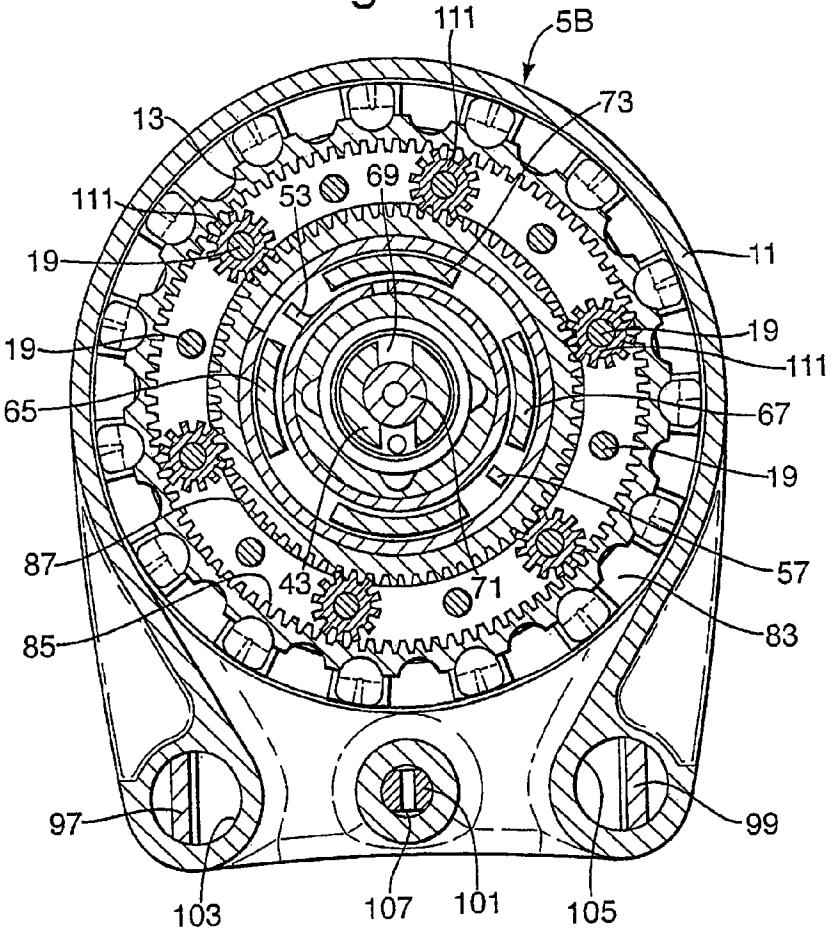
FIG. 10 is transverse cross section of the second embodiment according to line D-D in FIG. 9.
Figure 9:
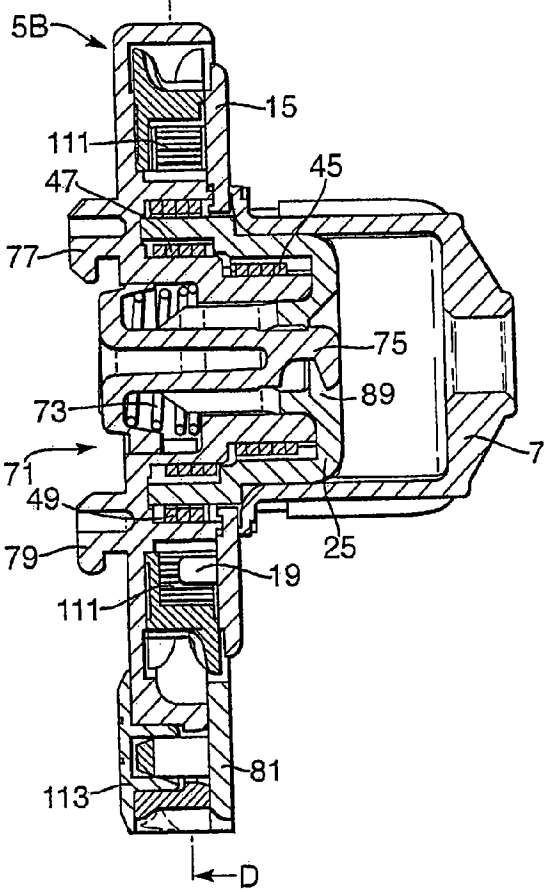
FIG. 9 is a longitudinal cross section through second embodiment of operating unit in assembled form.

Now turning to FIGS. 9 and 10 these are showing longitudinal and transverse cross sections through the assembled drive unit of the second embodiment 5B of FIG. 8. FIG. 10 is the transverse cross section according to the line D-D indicated in FIG. 9. It is further clarified in FIGS. 9 and 10 that the drive from the chain wheel 13 is driving is driving the engagement device 15 through satellite pinions 111 of which six are journalled on the pins 19. More precisely the internal gear teeth 85 of the chain wheel 13 are driving the gear pinions 111 which are in engagement also with the stationary external teeth 87 of the housing 11. As with the first embodiment the chain wheel 13 is driven by a conventional ball chain (not shown) which engages the circumferential cavities 83. The orbital movement of the pinion gears 111 around the stationary gear teeth 87 will rotate the engagement device 15 and its axially extending bosses 21, 23 including the boss portions 65 and 67 to engage the wrap spring tangs 53 and 57 to release the braking force the spring tangs 53, 57 then engage the boss portions 73 to rotate the connector 25. The connector 25 drives the adapter plug 7 which connects to a roller or like winding device to collect window covering material. For a further description of the parts making-up the second embodiment 5B, as visible in FIGS. 9 and 10 reference is made to the description relating to FIGS. 2 to 7, where identical parts have the same reference numerals.

Figures 11A, 11B, 11C:
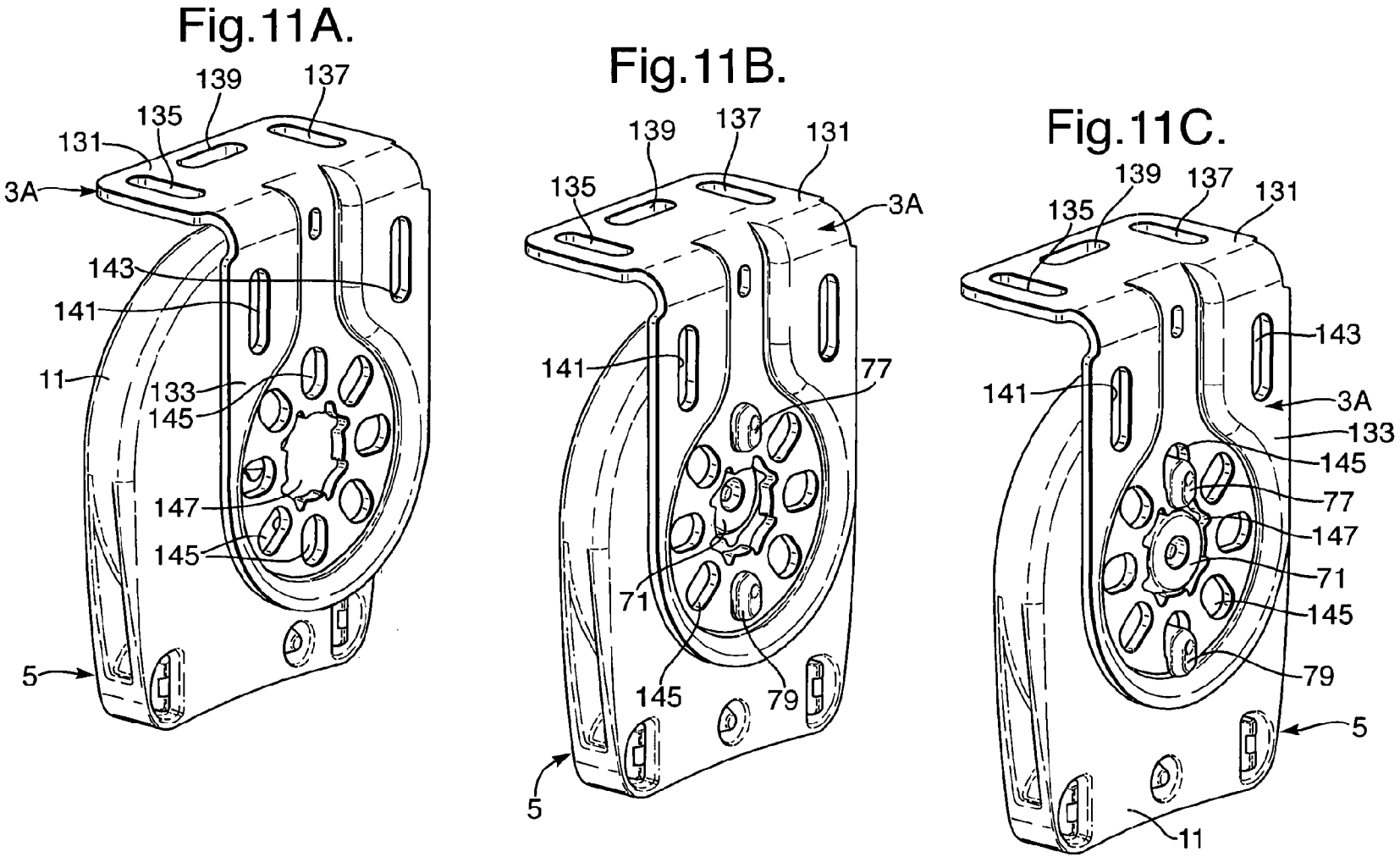
FIGS. 11A, 11B and 11C are the successive positions during attaching of an operating unit to a mounting bracket.

FIGS. 11A, 11B and 11C show the stages of mounting in operating unit 5 to a mounting bracket 3A. The mounting bracket 3A is similar to the mounting bracket 3 shown in FIG. 1, but if an alternative basic form without provisions to cooperate with a housing or headbox. The mounting that will be described is similar for both forms of mounting bracket. The mounting bracket 3A has a generally horizontally extending first flange 131 and a depending vertically extending second flange 133. The first flange 131 has slots 135, 137 and 139 for receiving fasteners (not shown, but conventional) to mount the first flange against either under a horizontal building surface or to a vertical building surface adjacent a window opening. The second flange 133 has similar slats 141 and 143 for alternative mounting to a vertical building surface in the proximity of a window opening.

For receiving the drive unit 5 the second flange 133 of the drive unit has a pattern of radially arranged slots 145 arranged around a central aperture 147. The spacing of each pair of radially aligned slots 145 corresponds to the spacing between the hook member 77 and 79 on the housing 11 of the drive unit 5. The arrangement of four pairs of radially aligned slots 145 allows for a selection of angular positions into which the drive unit 5 can be mounted in respect of the bracket flanges.

FIG. 11A shows the drive unit 5 being presented to the bracket 3A, but not yet engaged. FIG. 11B shows the first stage of engagement with the hook members 77 and 79 protruding through a vertically aligned slots 145. With this lowering movement accomplished as shown in FIG. 11C, the latch plug 71 will also have fully engaged the central aperture 147 by expansion of its spring 73 (shown in previous Figures). This will effectively lock the drive unit 5 to the bracket 3A and prevent it from becoming accidentally dislocated. Removal is only possible by having the latch plug 71 retract in the central bore 41 (as described hereinabove), sufficiently to unhook the hook members 77 and 79 from their respective slots 145.

Figure 12A:
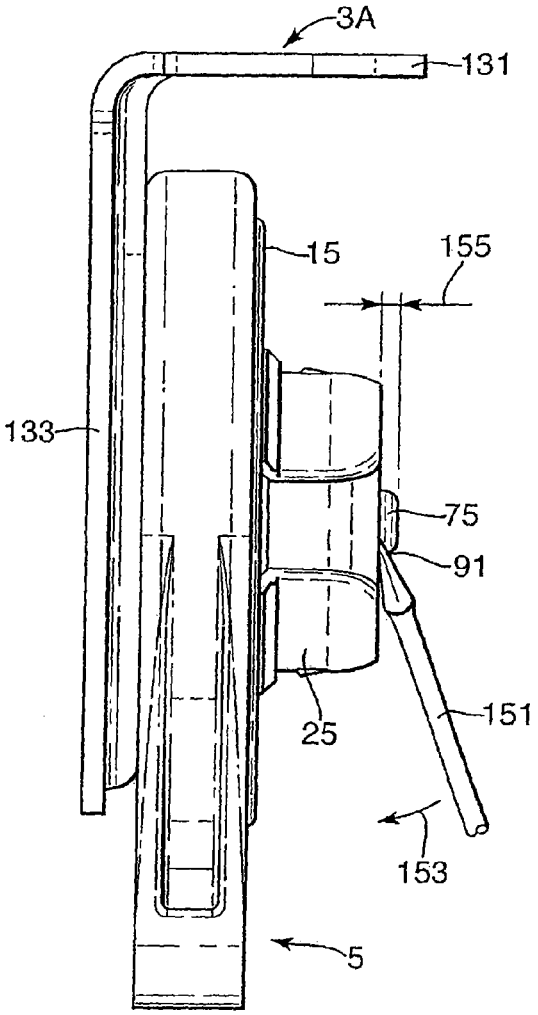
FIGS. 12A and 12B are the successive positions while detaching an operating unit from a mounting bracket.
Figure 12B:
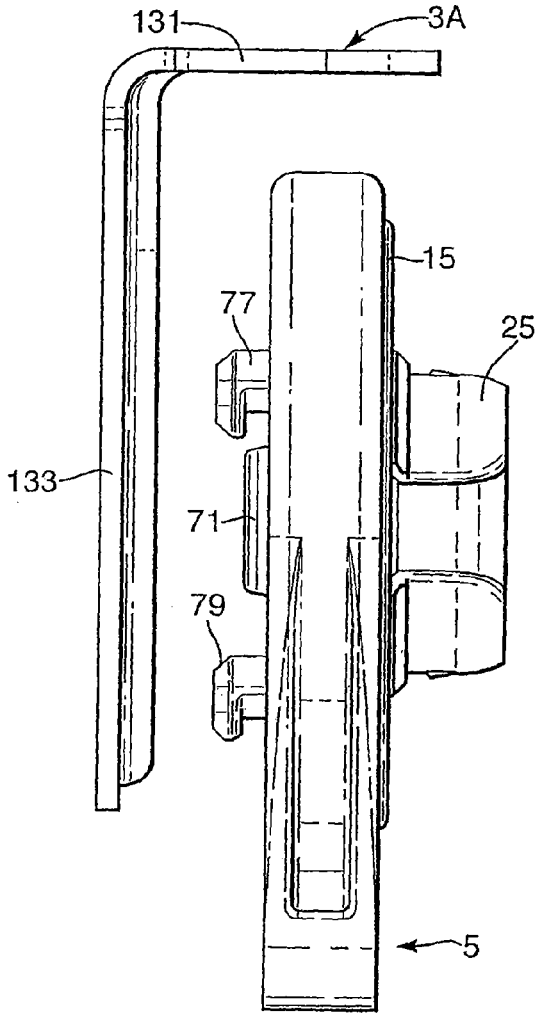

For the purpose of detaching the drive unit 5 from the bracket 3A one can conveniently press the latch plug 71 inwardly and unhook the drive unit from the bracket. However, with the bracket 3A in a position where the latch plug 71 cannot be reached an alternative as illustrated in FIGS. 12A and 12B is provided. In FIG. 12A the drive unit 5 us shown firmly attached to its bracket 3A. In this position a screw driver or like tool 151 is inserted into the recess 91 of the enlarged head 75 of the latch plug 71. By twisting the tool 151 in the direction of arrow 153, the latch plug 71 is retracted from the central aperture 147 (shown in FIG. 11A) over a distance 155 sufficient to raise the hooks 77 and 79 from their engagement with the bracket 3A, as shown in FIG. 12B.

It is thus believed that the operation and construction of the present invention will be apparent from the foregoing description. The term comprising when used in this description or the appended claims should not be construed in an exclusive or exhaustive sense but rather in an inclusive sense. Expressions such as: "means for . . . ". should be read as: "component configured for . . . " or "member constructed to . . . " and should be construed to include equivalents for the structures disclosed. The use of expressions like: "critical", "preferred", "especially preferred" etc., is not intended to limit the invention. Features which are not specifically or explicitly described or claimed may be additionally included in the structure according to the present invention without deviating from its scope.

The invention is further not limited to any embodiment herein described and, within the purview of the skilled person, modifications are possible which should be considered within the scope of the appended claims. Equally all kinematic inversions are to be considered within the scope of the present invention.

The invention claimed is:

1. Operating unit for operating a window covering, the operating unit including:

a housing;

a rotatable drive pulley having an axis of rotation and first and second mounting positions in the housing, with respect to the axis of rotation;

an engagement device, rotatable about the axis of rotation; and a brake mechanism for, in use, arresting the engagement device when the drive pulley is not rotated and preventing the engagement device and drive pulley from being back driven by the window covering, wherein the engagement device has a plurality of circumferentially spaced pins parallel to the axis of rotation, wherein the drive pulley has a corresponding plurality of openings facing the pins and wherein in the first mounting position the rotatable drive pulley has a first orientation with a first side of the rotatable drive pulley facing the engagement device and a second side of the rotatable drive pulley facing the housing, the pins on the engagement device engage with the corresponding openings in the drive pulley and the engagement device rotates with the drive pulley, while in the second mounting position the rotatable drive pulley has a second orientation with the first side of the rotatable drive pulley facing the housing and the second side of the rotatable drive pulley facing the engagement device, the pins do not so engage and the engagement device thereby can rotate relative to the drive pulley.

2. Operating unit according to claim 1, wherein the brake mechanism is operatively engaged between the housing and the engagement device.

3. Operating unit according to claim 2, wherein the drive pulley is in the second of the its mounting positions and wherein the operating unit further includes a planetary gear transmission.

4. Operating unit according to claim 2, wherein the brake mechanism includes a coiled wrap spring.

5. Operating unit according to claim 4, wherein the drive pulley is in the second of the its mounting positions and wherein the operating unit further includes a planetary gear transmission.

6. Operating unit according to claim 5, wherein the housing includes a stationary gear on a drum.

7. Operating unit according to claim 5, wherein the plurality of pins on the engagement device provides an option to selectively receive and rotatably support three, six or twelve satellite gear pinions.

8. Operating unit according to claim 4, wherein two wrap springs are housed concentrically.

9. Operating unit according to claim 1, wherein the brake mechanism includes a coiled wrap spring.

10. Operating unit according to claim 9, wherein two wrap springs are housed concentrically.

11. Operating unit according to claim 1, wherein the drive pulley is in the second of the its mounting positions and wherein the operating unit further includes a planetary gear transmission.

12. Operating unit according to claim 11, wherein the housing includes a stationary gear on a drum.

13. Operating unit according to claim 12, wherein the drive pulley includes a ring gear and wherein planetary satellite gear pinions are housed within the drive pulley.

14. Operating unit according to claim 11, wherein the drive pulley includes a ring gear and wherein planetary satellite gear pinions are housed within the drive pulley.

15. Operating unit according to claim 14, wherein the plurality of pins on the engagement device provides an option to selectively receive and rotatably support three, six or twelve satellite gear pinions.

16. Operating unit according to claim 11, wherein the plurality of pins on the engagement device provides an option to selectively receive and rotatably support three, six or twelve satellite gear pinions.

17. Operating unit according to claim 1, wherein the plurality of pins on the engagement device provides an option to selectively receive and rotatably support three, six or twelve satellite gear pinions.

18. In combination an operating unit according to claim 1 and a mounting bracket adapted to receive and support the operating unit.

19. The combination of claim 18, wherein the mounting bracket is adapted to form the end wall of a cassette housing.

20. The combination of claim 18, wherein the operating unit is engageable with the bracket in a plurality of angular positions.

21. The combination of claim 20, wherein one of the bracket and operating unit is provided with a plurality of slots which are arranged radially in oppositely aligned pairs and wherein the other of the bracket and operating unit is provided with a pair of aligned hooks for selective engagement with one pair of aligned slots.

22. The combination of claim 21, wherein the housing has a central bore, housing a latch plug that is resiliently biased to a protruding position, but which can be moved inwardly to a position in which it does not extend from a surface of the housing.

23. The combination of claim 22, wherein the slots are formed in the bracket and the pair of hooks on the housing.

24. The combination of claim 21, wherein the slots are formed in the bracket and the pair of hooks on the housing.

* * * * *